United States Patent [19]

McSwain

[11] 4,231,514

[45] Nov. 4, 1980

[54] AUTOMATIC VENTILATOR

[76] Inventor: Edward D. McSwain, Rte. 7, Box 325, Lincolnton, N.C. 28092

[21] Appl. No.: 73,892

[22] Filed: Sep. 10, 1979

[51] Int. Cl.[3] ..... F24F 7/00

[52] U.S. Cl. ..... 236/49; 98/40 VT; 137/625.28; 160/92

[58] Field of Search ..... 160/89, 92 X; 236/49; 98/107, 110, 121 A, 40 VT; 137/625.28; 251/212

[56] References Cited

U.S. PATENT DOCUMENTS

| | | | |
|---|---|---|---|
| 1,757,048 | 5/1930 | Janeczko | 160/92 X |
| 2,771,133 | 11/1956 | Haskell | 160/89 |
| 2,890,717 | 6/1959 | Werder | 137/625.28 X |
| 3,195,441 | 7/1965 | Hedrick | 98/40 |
| 3,363,536 | 1/1968 | Dean, Jr. | 236/49 X |
| 3,368,756 | 2/1968 | Edwards | 236/49 |
| 3,436,016 | 4/1969 | Edwards | 236/49 |
| 3,528,606 | 9/1970 | Witten | 236/48 |
| 3,645,108 | 2/1972 | Houk | 236/49 X |

*Primary Examiner*—Lloyd L. King
*Assistant Examiner*—William E. Tapolcai, Jr.
*Attorney, Agent, or Firm*—Luke J. Wilburn, Jr.; Wellington M. Manning, Jr.

[57] ABSTRACT

An improved wall ventilator for use in building constructions comprising a housing having a peripheral wall member defining an air flow passageway, a first louver section comprising a fixed panel having a plurality of openings therethrough and attached to said peripheral wall members to extend across a front portion of the passageway, a second movable louver section comprising a plurality of movable panels extending in side by side relation and having a plurality of openings extending therethrough and alternately spaced with respect to the openings in the first louver section fixed panels whereby imperforate portions of each section of panels overlie the openings of the other when the movable second section panels are located in a common plane and in a first position immediately adjacent the rear face of the fixed panel to close the housing passageway, and a temperature responsive bimetallic spring operatively connected to the movable panels to pivot the same away from the first fixed panel to a second position where the movable panels lie in non-parallel planes to expose the openings through the panels and permit passage of air through the housing passageway.

The housing and louver sections of the ventilator may be formed of molded plastic material to provide a lightweight construction having nominal moving parts.

11 Claims, 6 Drawing Figures

AUTOMATIC VENTILATOR

This invention relates to an improved wall ventilator construction and, more particularly, to a temperature responsive, automatically regulated wall ventilator having adjustably positionable louvers therein for opening and closing the air flow passageway through the ventilator.

BACKGROUND OF THE INVENTION

It is well known to provide ventilation to enclosed spaces of buildings, such as crawl spaces and basements, by the use of ventilators located in suitable openings of the foundation enclosure walls. Such ventilators are generally provided with adjustable closure means, such as shutters or louvers, to control the flow of air to and from the enclosed space, depending on temperature, weather conditions or seasonal changes. Generally such foundation wall ventilators are secured in the wall opening during construction of the foundation wall by cement, mortar, or other fastening materials.

It is also known to provide temperature responsive control of the closure shutters or louvers of such ventilators by the use of a bimetallic temperature responsive spring which may be operatively connected between the fixed housing of the ventilator and the movable shutters in such a way that expansion or contraction of the spring due to temperature changes causes pivotal movement of the shutters from open to closed positions in the air flow passageway through the ventilator housing. Typical of such devices are disclosed in the following patents: French Pat. No. 1,377,998 U.S. Pat. Nos. 3,068,776, 2,187,767, 3,195,441, 2,241,108, 3,368,756, 2,551,965, 3,436,016, 3,027,090, 3,528,606.

Above-mentioned U.S. Pat. No. 3,436,016 discloses a temperature responsive foundation ventilator construction having bimetallic spring operatively connected between fixed housing and movable shutters to provide for controlled movement thereof in response to predetermined temperature changes in the air passing through the shutter.

Although many such temperature responsive spring controlled louvered ventilators are known and used in the field of the art, there is the ever present need of providing a temperature responsive automatically controlled ventilator construction which can be more easily and economically manufactured with improved reliability of performance in use.

OBJECTS OF THE INVENTION

It is therefore an object of the present invention to provide an improved wall ventilator construction having an adjustable louver section movable in response to temperature change conditions to open and close the ventilating passageway of the wall ventilator.

It is another object to provide an economical lightweight wall ventilator construction with temperature responsive movable louver section.

It is still another object to provide an improved lightweight molded plastic wall ventilator construction having adjustable louver section for controlling air flow therethrough, and composed of nominal moving parts regulatable by a temperature responsive bimetallic spring.

BRIEF DESCRIPTION OF THE DRAWINGS

The above as well as other objects of the present invention will become more apparent from the following detailed description of preferred embodiments thereof, when taken in connection with the accompanying drawings, in which.

BRIEF DESCRIPTION OF THE INVENTION

Broadly, the present invention comprises a lightweight economical wall ventilator composed of a housing having an air flow passageway therethrough, and a louver mechanism disposed in the housing for opening and closing the passageway in response to temperature change. The louver mechanism comprises a first louver section composed of a fixed louver panel attached to and forming a front face of the ventilator housing and having a plurality of spaced openings therethrough. Disposed behind the fixed panel is a second louver section composed of a plurality of movable louver panels hingedly interconnected along their adjacent side edges and having a corresponding plurality of openings therethrough located in alternately spaced relation to the openings in the first louver section panel. Pivotal movement of the second plurality of panels about their interconnected side edges into a common plane parallel to and immediately behind the first louver section panel closes the openings in the first and second louver section panels to seal the air flow passageway, while pivotal movement of the second louver section panels to position them in non-parallel planes exposes the openings through the panels to permit passage of air through the passageway. A temperature responsive, bimetallic spring is operatively attached to the movable panels of the second louver section to pivotally move the panels, in response to temperature changes, to open or close the passageway.

DETAILED DESCRIPTION OF PREFERRED EMBODIMENTS

Figure 1:
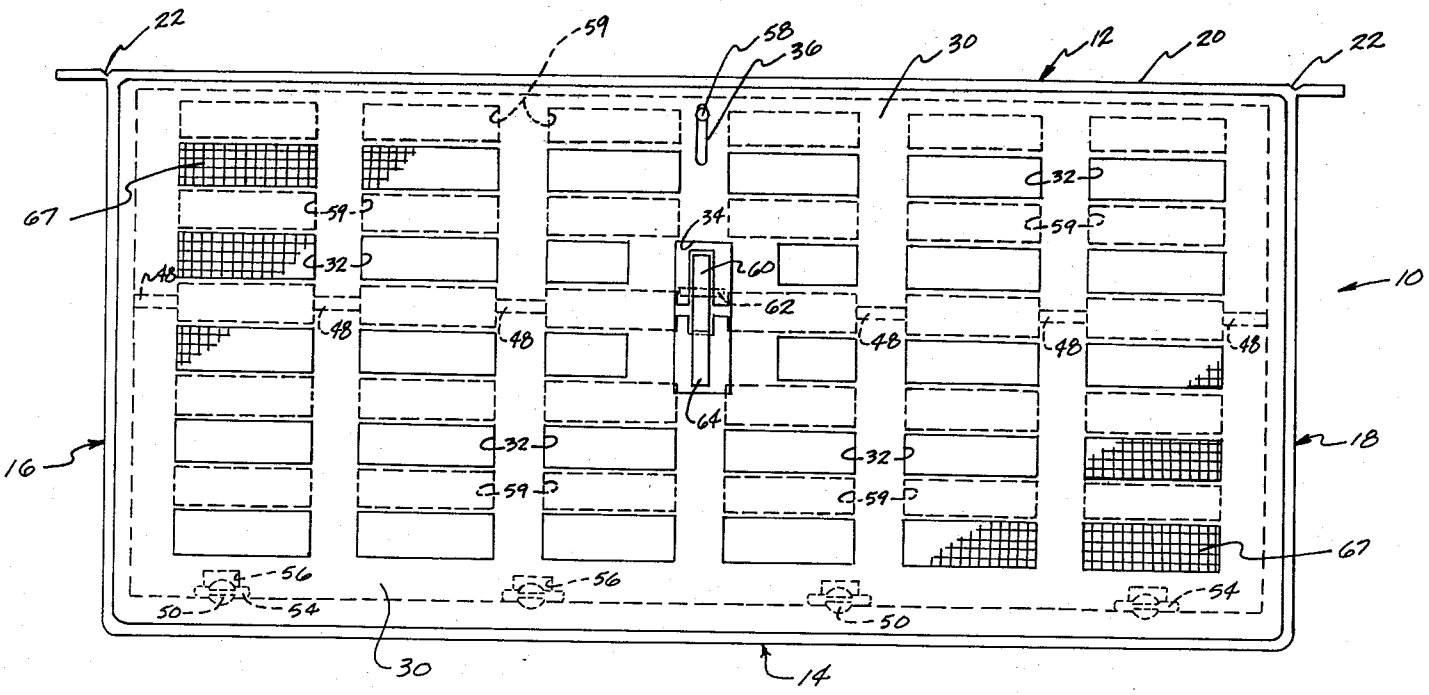
FIG. 1 is a front elevation view of the wall ventilator of the present invention, with louver section panels thereof positioned to close the air flow passageway through the ventilator.
Figure 2:
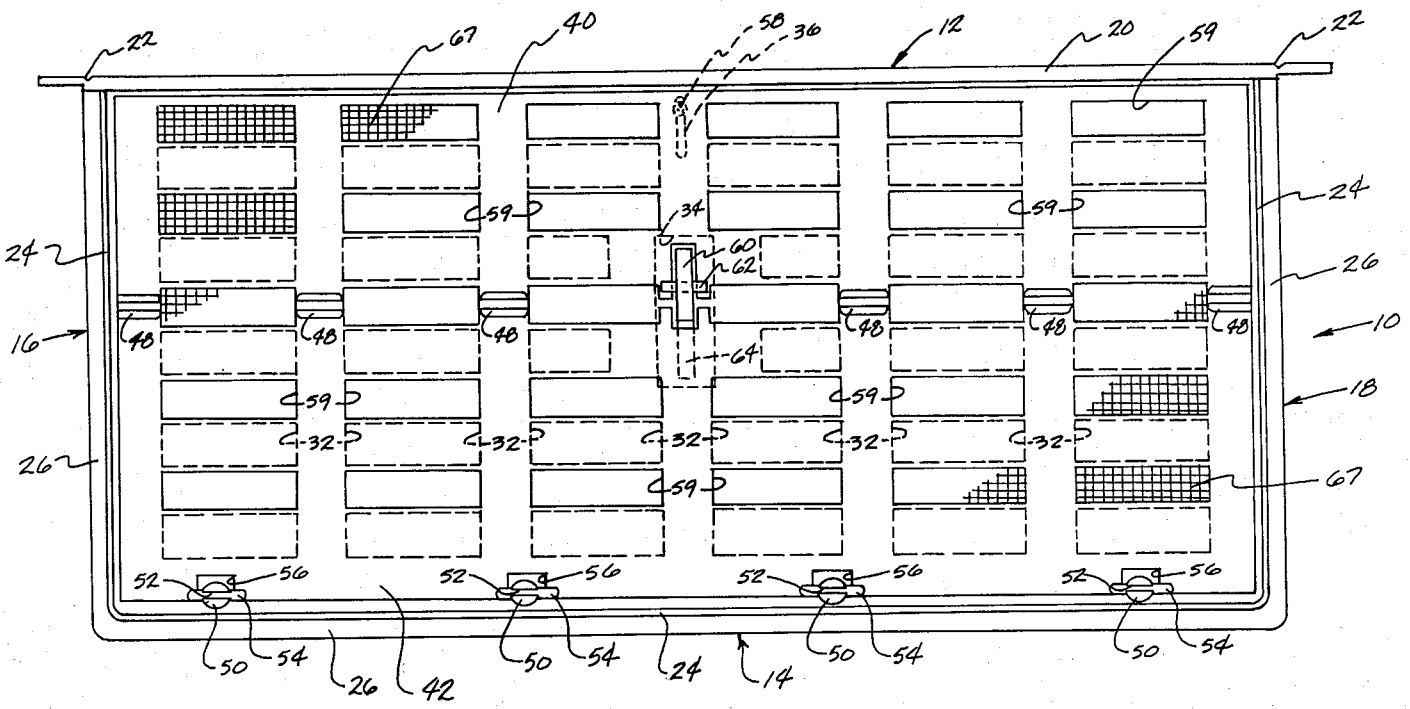
FIG. 2 is a rear elevation view of the ventilator of FIG. 1.

Referring more particularly to the drawings, FIGS. 1 and 2 are respective front and rear elevation views of the wall ventilator of the present invention, with louver mechanism shown in closed position to seal the air flow passageway of the ventilator. As shown, the ventilator comprises a unitarily molded plastic housing 10 having opposed generally parallel top and bottom wall members 12, 14 and opposed side wall members 16, 18 which together define the periphery of a generally rectangular ventilating passageway through the housing.

Figure 3:
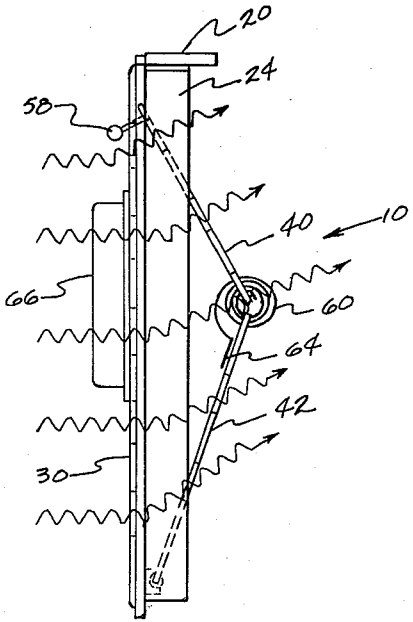
FIG. 3 is a side elevation view of the ventilator of FIG. 1, and illustrating the position of the movable louver section panels of the louver mechanism to permit passage of air through the ventilator passageway.

Extending across the top of the housing for a distance beyond each side wall member 16, 18 is a lentil 20 which facilitates support and placement of masonry materials of a foundation wall when the ventilator is installed in the foundation wall during its initial construction. Lentil 20 is molded with weakened areas or score lines 22 at the points of termination of the side wall members so that, when desired, the portions of the lentil which extend outwardly beyond the side wall members may be broken away, and the ventilator can be inserted into an existing foundation wall opening without having to modify the masonry around the opening. As seen in FIGS. 1–3, the peripheral wall members of the housing include wall portions 24 (FIG. 3) which extend in planes parallel to the central axis of the ventilating passageway, and flange portions 26 (FIG. 2) which extend in planes perpendicular to the central axis of the passageway to overly the periphery of a foundation wall opening in which the ventilator is located.

The ventilator housing passageway is provided with an adjustable louver mechanism which comprises a first louver section composed of a front louver panel 30 unitarily formed with the peripheral walls of housing 10 and extending across the passageway to form a front face of the housing. The fixed louver panel 30 is provided with a plurality of uniformly spaced rectangular openings 32 extending therethrough. A central portion of panel 30 is provided with a vertically extending opening 34 for reception of a bimetallic temperature responsive control spring of the louver mechanism, as will be explained, and the upper central portion of panel 30 has an elongate, vertically extending narrow slot 36.

As seen in FIGS. 1–3, located in the passageway behind the fixed panel 30 is a second, movable louver section composed of a pair of elongate panels 40, 42 which extend in side-by-side relation across the width of the housing passageway and are pivotally interconnected along their adjacent side edges by spaced hinge means, shown as foldable plastic webs of material 48, which are unitarily formed with panels 40, 42 in a molding operation.

The lower edge portion of bottom panel 42 is pivotally attached to the fixed front panel 30 of housing 10 by means of a plurality of rearwardly extending plastic protrusions 50 (FIGS. 1 and 2) having horizontal grooves 52 therein. The protrusions are formed unitarily with the housing and front louver panel during the molding operation. The lower edge of lower panel 42 is provided with correspondingly spaced pivot pins 54 which span notched portions 56 in the edge of the panel, with the pivot pins being unitarily formed with panels 40, 42 during molding. Each protrusion groove 52 frictionally engages a corresponding pivot pin of the lower panel, in snap-fit relation, to provide a pivotally hinged connection of the movable panels 40, 42 to the lower portion of the housing.

Extending from the upper edge portion of the upper movable louver panel 40 at a midpoint along its length is a fastening member, or tab 58, which extends through the vertical slot 36 in front panel 30 and has an enlarged tip to maintain the tab in the slot for sliding movement therealong. Thus, movable louver panel 40 is operatively connected to fixed panel 30 so that its upper edge is free to slide along the rear face of panel 30 during pivotal, or folding, movement of the two panels about their interconnected adjacent side edges (note FIG. 3).

As can be seen in FIGS. 1 and 2, movable panels 40, 42 are provided with a plurality of rectangular openings 59 which are alternately spaced therein with respect to openings 32 of fixed panel 30 such that the imperforate portions of panels 30, 40, and 42 serve to block or seal the openings 32 and 59 of the louver panels when movable panels 40, 42 are positioned in a common vertical plane immediately behind panel 30, thus blocking the air flow passageway through the housing.

As seen in FIGS. 1–3, operatively attached to the two movable louver panels 40, 42 at a midpoint along their interconnected side edges is a temperature responsive bimetallic coiled spring 60. Spring 60 resides in a vertical slot in the lower edge of upper panel 40 and its innermost end is fixedly secured to upper panel 40 by suitable means, such as a fastening member 62 attaching the inner end of the spring to the rear face of the upper panel. As best seen in FIG. 3, the bent outer end 64 of control spring 60 operatively engages the front face of the upper portion of lower movable panel 42 and is slidable therealong during contraction and expansion of the spring due to temperature changes. The force exerted on the panels 40, 42 by expansion and contraction of spring 60 causes pivotal movement of the panels from a first position (FIGS. 1 and 2) in which the panels lie in a common plane immediately behind front panel 30 to close the ventilator passageway, and a second position in which the panels lie in non-parallel diagonal planes (FIG. 3) to expose the openings through the louver panels and permit passage of air through the passageway.

Although not shown in FIGS. 1 and 2, but seen in FIG. 3, the front face of the fixed louver panel 30 may be provided with a protective cover 66 which houses and protects bimetallic spring 60 when panels 40, 42 are moved by force of the spring to close the ventilator passageway. The air flow passageway of the ventilator, as well as the temperature responsive control spring, is further protected by means of a wire screen 67, suitably positioned and located on the rear face of the front louver panel 30.

Thus, it can be understood that when the temperature of the surrounding air rises to cause expansion of control spring 60, forces of expansion of the spring are exerted on movable panels 40, 42 to pivot or fold the same about their interconnected sides and move the front faces of the panels away from the rear face of front panel 30 (FIG. 3), thereby exposing the panel openings to allow air to pass through the passageway. Conversely, when the temperature of the surrounding air falls, the temperature responsive spring contracts to produce force on the movable panels to pivot the same into a common plane behind the front panel, thus closing the panel openings and the ventilator passageway. The extent of movement of the panels about their interconnected side edges is controlled by sliding movement of the fastening tab 58 in the elongate slot of front panel 30. Preferably, the movable panels 40, 42 of the louver mechanism are pivotally attached to the lower portion of the front panel or housing, rather than the upper portion, so that the weight of the movable panels assists the force of spring 60 in moving the panels to open the air flow passageway.

Figure 4:
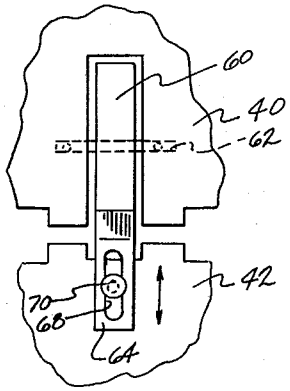
FIG. 4 is an enlarged broken-away front elevation view of the temperature responsive control spring of the louver mechanism, and illustrating a modified form of attachment of the spring to the movable panels of the louver mechanism.

FIG. 4 shows a modified form of operative attachment of control spring 60 to movable panels 40, 42, in which the outer bent end portion 64 of the spring is provided with a slot 60 which receives a guide pin 70 attached to the front face of lower panel 42 for sliding movement therein.

Figure 5:
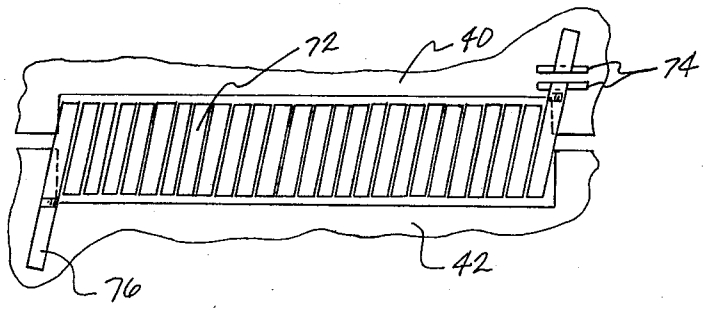
FIG. 5 is an enlarged broken-away view of an alternate form of temperature responsive control spring which may be operatively attached to the movable louver panels of the louver mechanism to move them in response to temperature changes.

FIG. 5 illustrates another embodiment of the invention, wherein the temperature responsive control spring may be an elongate helical spring 72, one end of which is fixedly attached to the lower edge portion of upper movable panel 40, as by extending through spaced slots 74 therein, and the other end 76 of which operatively engages the front face of the upper edge portion of lower panel 42. In such embodiment, the panels are correspondingly moved between opened and closed positions by contraction and expansion of the spring due to temperature change, as previously explained. In the use of the helical spring in FIG. 5, front panel 30 of the louver mechanism would be suitably slotted to receive the spring therein when the movable panels are in closed position, and a suitable closure cover would be provided for the spring, as illustrated for the coil spring in FIG. 3.

From the foregoing description of preferred embodiments, it can be appreciated that the ventilator of the present invention may be readily employed in new and pre-existing building wall openings to automatically ventilate the interior portions of the building in response to changes in temperature conditions of the environment. Due to the simplified construction of the ventilator, it may be economically manufactured of nominal components in a plastic molding operation.

That which is claimed is:

1. An improved wall ventilator for use in building constructions comprising:

(a) a housing having peripheral wall means defining an air flow passageway through the housing;

(b) a first louver section attached to said peripheral wall means and extending across a front portion of said passageway, said first section comprising a fixed panel having a plurality of spaced openings extending therethrough;

(c) a second, movable louver section positioned in and extending across said passageway behind said first louver section panel, said second louver section comprising a plurality of movable panels extending in side by side relation and being pivotally interconnected along their adjacent side edges to move about said edges;

(d) means pivotally connecting the opposite side edge portion of an end one of said second louver section panels to an adjacent side of said first louver section or housing wall means;

(e) means operatively connecting the opposite side edge of the other end one of said second louver section panels to said first louver section panel for sliding movement of said side edge along the rear face of said first louver section panel in response to pivotal movement of said plurality of second louver section panels about their interconnected adjacent side edges;

(f) said second louver section panels being pivotally movable between a first position wherein said panels thereof lie in a common plane parallel to and closely adjacent the plane of said first section panel, and a second position wherein said second louver section panels pivot about their interconnected side edges to lie in planes which are nonparallel to the plane of said first louver section panel;

(g) said second louver section panels having a plurality of openings therethrough alternately spaced therein with respect to said fixed panel openings such that imperforate portions of said first and second louver section panels overlie the openings of the other when said second section panels are in said first position to close the air flow passageway of the housing; and (h) means attached to said second louver section panels for moving said second louver section panels between said first and second positions to respectively close and expose said openings of said first and second louver section panels and control passage of air through said housing air flow passageway.

2. A ventilator as defined in claim 1 wherein said means for moving said second louver section panels comprises temperature responsive means operatively attached thereto for automatically moving said panels in response to temperature changes.

3. A ventilator as defined in claim 2 wherein said temperature responsive means comprises a bimetallic spring having one end attached to a innerconnected side edge portion of one of said second section panels and the other end operatively engaging the adjacent side edge portion of the next adjacent interconnected panel thereto, whereby expansion and contraction of said bimetallic spring in response to temperature changes produces a force on said panels to cause pivotal movement thereof about their interconnected sides.

4. A ventilator as defined in claim 3 wherein said second louver section panels are of unitary plastic construction and wherein said means pivotally interconnecting adjacent side edges of said panels comprises one or more webs of foldable plastic material.

5. A ventilator as defined in claim 3 wherein said means operatively connecting the opposite side edge of said other end one of said second louver section panels for sliding movement along the rear face of said first louver section panel comprises an elongate slot in said first louver section panel extending perpendicular to the axis of pivotal movement of said second louver section panels about their interconnected edges, and tab means on said opposite side edge portion of said other end panel extending through said slot and engaging the front face of said first louver section panel for movement therealong.

6. A ventilator as defined in claim 3 wherein said housing peripheral walls comprise opposed top, bottom and side walls defining a generally rectangular air flow passageway through the housing, said first louver section panel is of corresponding generally rectangular configuration and spans said passageway, said second louver section panels comprise a pair of panels of generally rectangular configuration extending in side by side relation across said passageway between said side walls of the housing, the lower side edge portion of the lower of said second section panels being connected by said pivotal connecting means to the lower portion of said first louver section panel, and the upper side edge portion of said upper panel of said second louver section panels being operatively connected by said tab means to the upper portion of said first louver section panel for movement of said second section panels between said first and second positions.

7. A ventilator as defined in claim 6 wherein said one end of said bimetallic spring is supportably attached to the lower side edge portion of said upper second section panel, and said other end of said spring operatively engages the upper side edge portion of said lower second section panel whereby said pair of panels are moved to said second position during expansion of said bimetallic spring, and are moved to said first position during contraction of said bimetallic spring.

8. A ventilator as defined in claim 7 including a slot in said other end of said spring, and fastening means on said lower second section panel extending through said slot and being slidable therealong during contraction and expansion of said spring.

9. A ventilator as defined in claim 8 wherein said spring is a coiled spring element.

10. A ventilator as defined in claim 7 wherein said spring is an elongate helical spring element.

11. A ventilator as defined in claim 3 wherein said temperature responsive bimetallic spring is attached to said second section panels such that its axis of expansion and contraction is generally parallel to the axis of pivotal movement of the adjacent interconnected second section panels to which it is operatively attached, and protective cover means on said first section panel for receiving said bimetallic spring therein when said second louver section panels are in said first position in which they cooperate with said first section panel to close the air flow passageway through said housing.

* * * * *